US012799575B2

(12) United States Patent
Monerie-Moulin et al.

(10) Patent No.: US 12,799,575 B2
(45) Date of Patent: Nov. 17, 2026

(54) METHOD FOR MANUFACTURING A PART COMPRISING A METAL SUBSTRATE COVERED WITH A PROTECTIVE LAYER

(71) Applicant: SAFRAN LANDING SYSTEMS, Velizy-Villacoublay (FR)

(72) Inventors: Francis Monerie-Moulin, Moissy Cramayel (FR); Mathilde Arnoux, Moissy Cramayel (FR)

(73) Assignee: SAFRAN LANDING SYSTEMS, Velizy-Villacoublay (FR)

( * ) Notice: Subject to any disclaimer, the term of this patent is extended or adjusted under 35 U.S.C. 154(b) by 0 days.

(21) Appl. No.: 18/859,844

(22) PCT Filed: Apr. 20, 2023

(86) PCT No.: PCT/FR2023/050571
§ 371 (c)(1),
(2) Date: Oct. 24, 2024

(87) PCT Pub. No.: WO2023/209313
PCT Pub. Date: Nov. 2, 2023

(65) Prior Publication Data

US 2025/0270683 A1 Aug. 28, 2025

(30) Foreign Application Priority Data

Apr. 25, 2022 (FR) ..... 2203827

(51) Int. Cl.
*C23C 4/02* (2006.01)
*C23C 4/10* (2016.01)
*C23C 4/129* (2016.01)

(52) U.S. Cl.
CPC ..... *C23C 4/02* (2013.01); *C23C 4/10* (2013.01); *C23C 4/129* (2016.01)

(58) Field of Classification Search
CPC .... C23C 4/02; C23C 4/06; C23C 4/10; C23C 4/129; B05D 1/08; B05D 1/10; B05D 1/12; B05D 2350/38
See application file for complete search history.

(56) References Cited

U.S. PATENT DOCUMENTS

2004/0110016 A1* 6/2004 Hamaya ..... C23C 4/11 428/472
2007/0071921 A1 3/2007 Coulas
(Continued)

FOREIGN PATENT DOCUMENTS

CN 103953772 A * 7/2014 ..... C23C 14/35
EP 2 956 564 B1 8/2019
(Continued)

OTHER PUBLICATIONS

Schwetzke et al., "Microstructure and Properties of Tungsten Carbide Coatings Sprayed with Various High-Velocity Oxygen Fuel Spray Systems," Journal of Spray Technology, vol. 8(3) Sep. 1999, 433-439. (Year: 1999).*
(Continued)

*Primary Examiner* — William P Fletcher, III
(74) *Attorney, Agent, or Firm* — CUSHMAN PARTNERS LLC

(57) ABSTRACT

A method for manufacturing a part includes a metal substrate at least partially covered with a finished protective layer, the method including preparing an initial surface to produce a rough surface, without sandblasting, the preparing including shot-blasting an initial surface of the substrate to obtain a roughness having an overall height Rt of between 10 μm and 15 μm and cleaning the rough surface; forming, by spraying a powder mixture containing submicron metal carbide grains according to a HVOF thermal spraying method, on the cleaned rough surface, a rough coating layer, to a thickness of between 95 μm and 120 μm; and polishing
(Continued)

the surface of the rough coating layer formed from the powder mixture so as to form the finished protective layer having a thickness of between 75 μm and 100 μm, thus forming a polished surface having a roughness of less than 0.2 μm.

4 Claims, 5 Drawing Sheets

(56) References Cited

U.S. PATENT DOCUMENTS

| | | | | |
|---|---|---|---|---|
| 2007/0261767 | A1* | 11/2007 | Jarosinski | C23C 4/18 106/287.35 |
| 2016/0032440 | A1* | 2/2016 | Monerie-Moulin | C23C 4/129 427/451 |
| 2019/0119802 | A1 | 4/2019 | Suidzu et al. | |

FOREIGN PATENT DOCUMENTS

| | | | | |
|---|---|---|---|---|
| FR | 3 002 239 | A1 | 8/2014 | |
| KR | 20100114408 | A * | 10/2010 | C23C 4/18 |
| WO | WO 2014/125045 | A1 | 8/2014 | |

OTHER PUBLICATIONS

Majority, Oxford English Dictionary, https://oed.com/dictionary/majority_n1?tab=meaning_and_use#38199019 (last accessed Dec. 11, 2025). (Year: 2025).*

Surface Roughness Parameters, https://www.keyence.com/ss/products/microscope/roughness/line/parameters.jsp (last accessed Dec. 11, 2025). (Year: 2025).*

"HVOF Thermal Spray," TSSsrl, tsssrl.eu/services/hvof-thermal-spray/ (last accessed Dec. 11, 2025). (Year: 2025).*

International Search Report as issued in International Patent Application No. PCT/FR2023/050571, dated Jun. 16, 2023.

* cited by examiner

[Figure 1a]
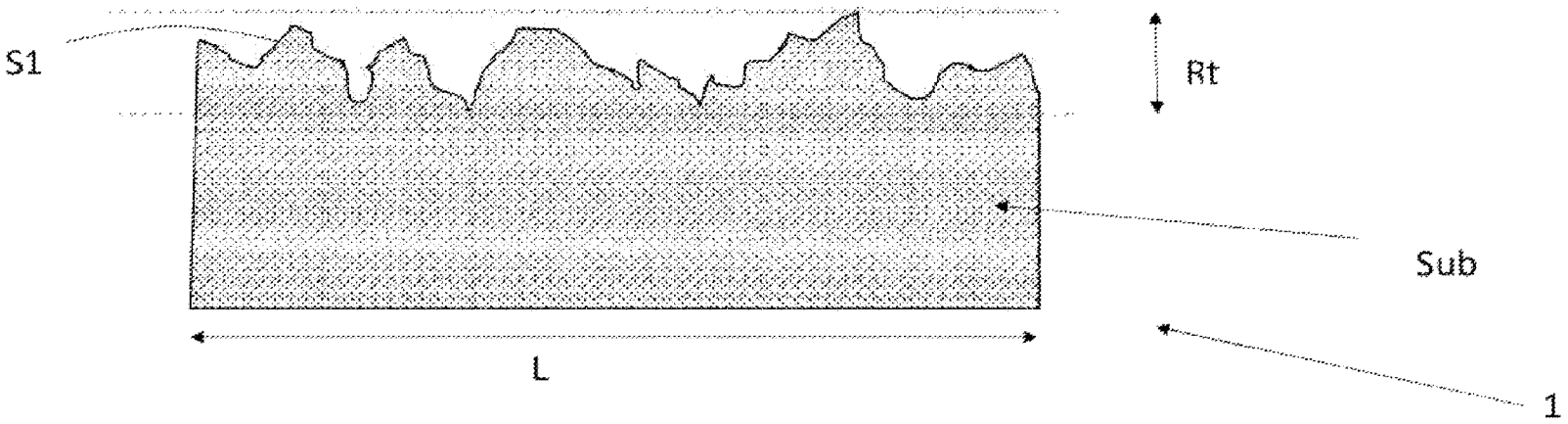

[Figure 1b]
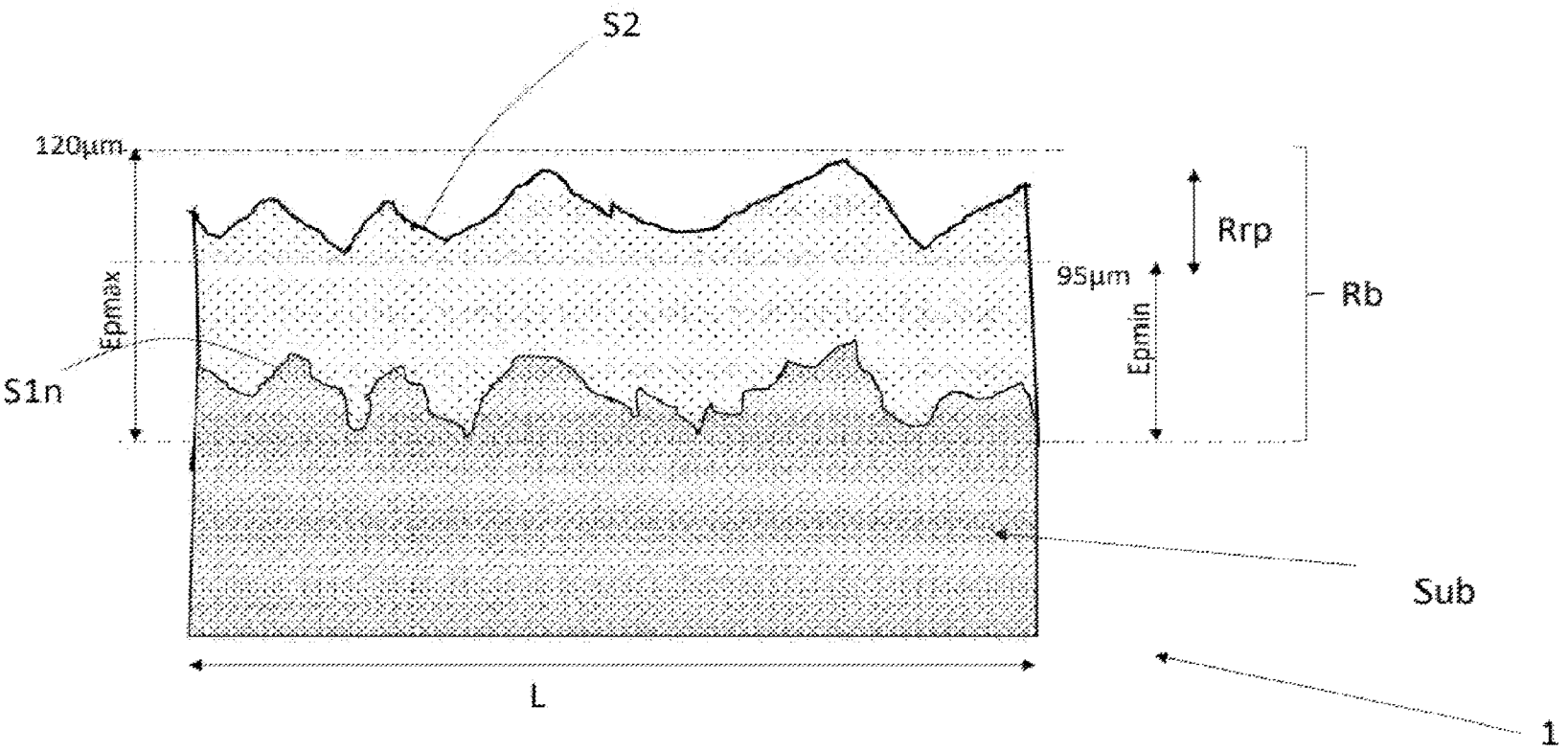

[Figure 1c]
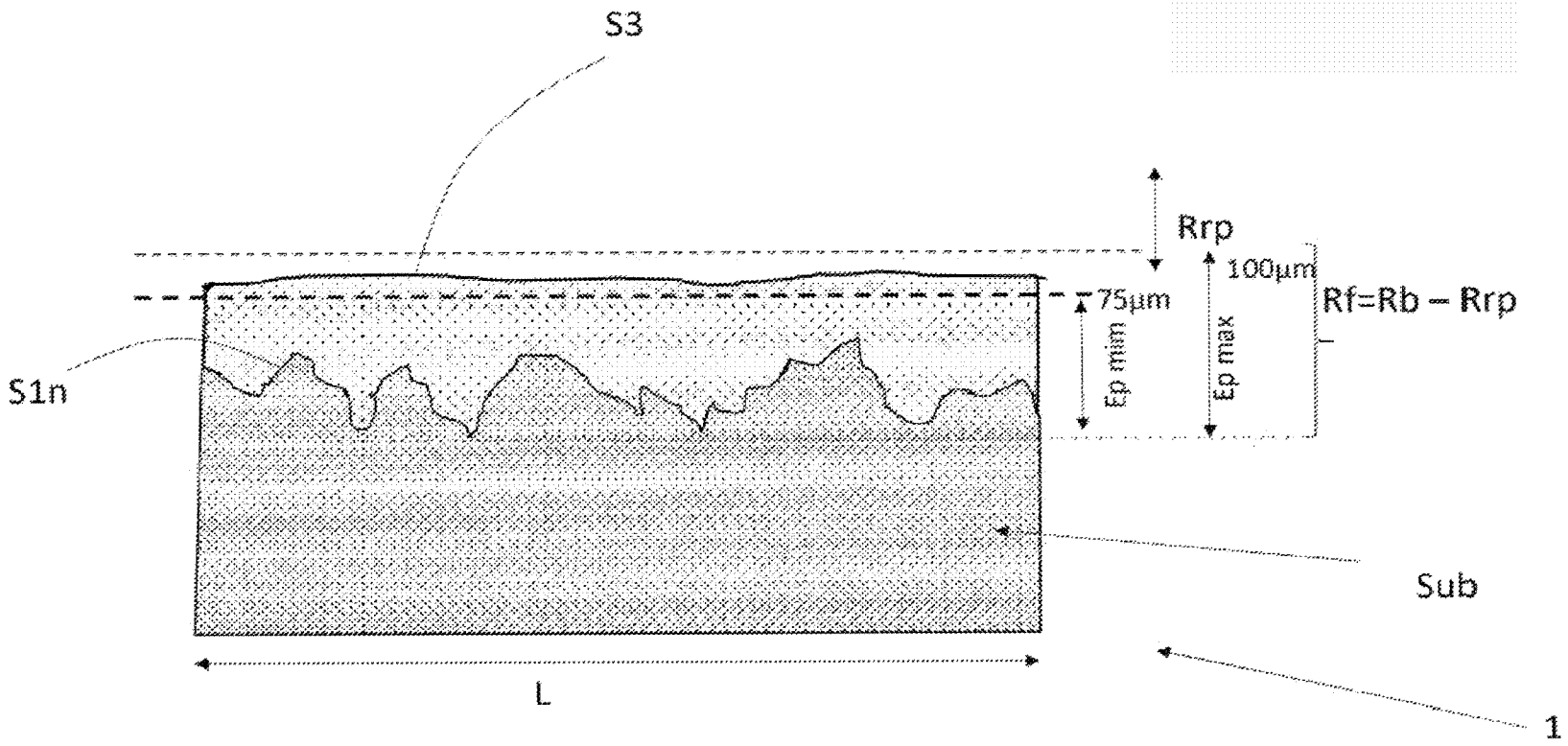

[Fig. 2]
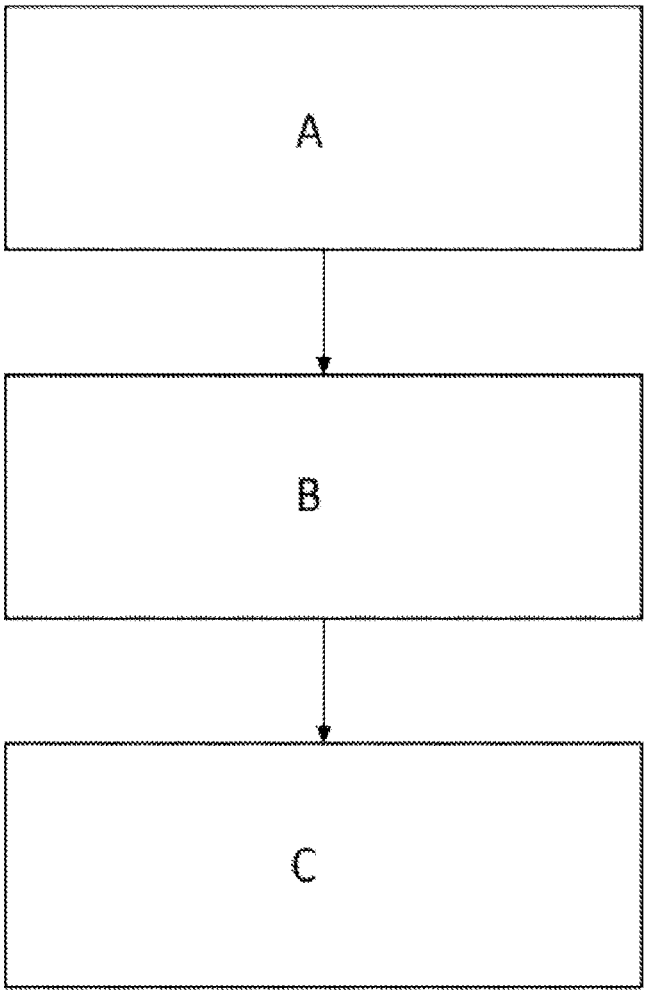

[Fig.3]
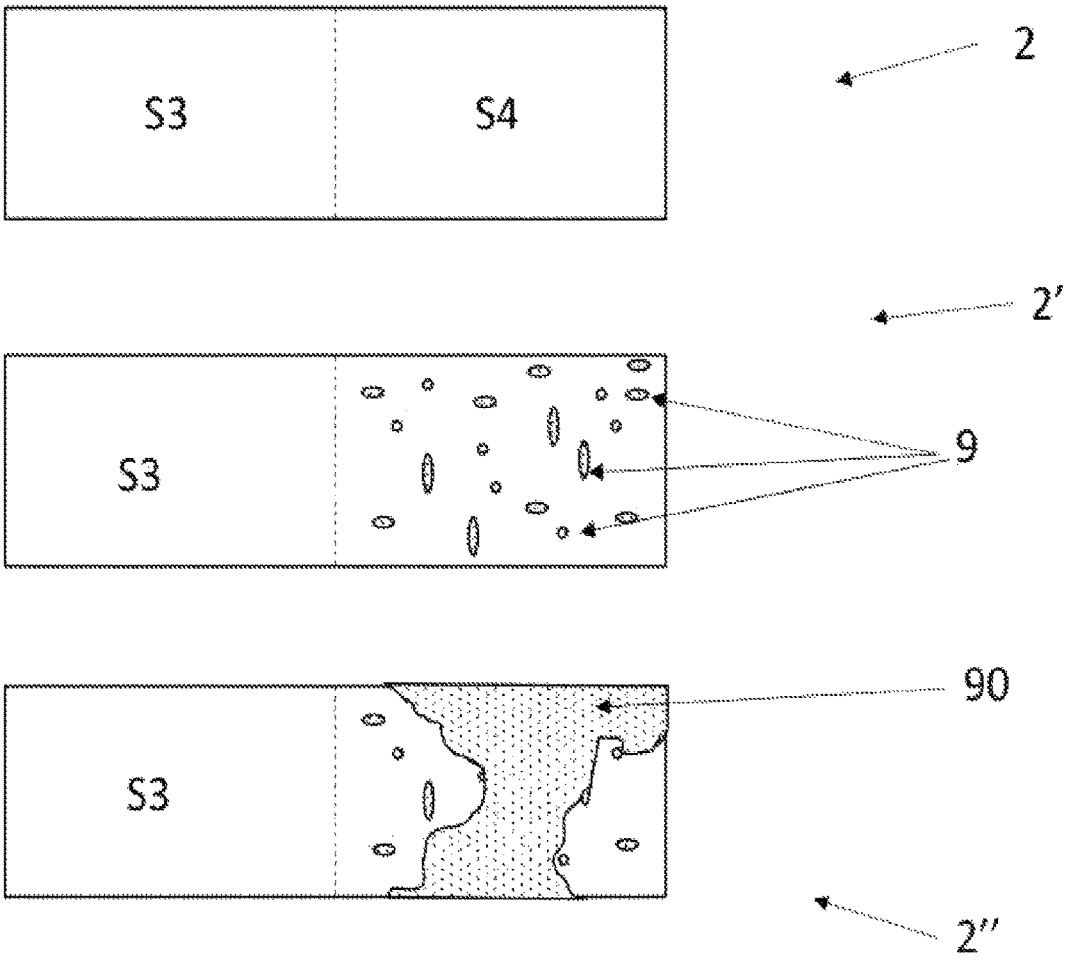

METHOD FOR MANUFACTURING A PART COMPRISING A METAL SUBSTRATE COVERED WITH A PROTECTIVE LAYER

CROSS-REFERENCE TO RELATED APPLICATIONS

This application is the U.S. National Stage of PCT/FR2023/050571, filed Apr. 20, 2023 which in turn claims priority to French patent application number 2203827 filed Apr. 25, 2022. The content of these applications are incorporated herein by reference in their entireties.

TECHNICAL FIELD OF THE INVENTION

The technical field of the invention is that of a method for manufacturing parts, such as aeronautical parts, including a substrate at least partially coated with a protective layer protecting this substrate.

The present invention relates to a method for manufacturing a part comprising a metal substrate at least partially covered with a protective layer.

TECHNOLOGICAL BACKGROUND OF THE INVENTION

For example, methods for manufacturing parts are known which include applying to a metal substrate, via a metal bath, a hard chromium coating layer serving both to protect this substrate and to impart functional roughness thereto.

It is known to produce the hard chromium coating layer in an electrolytic cell in the presence of hexavalent chromium-based (Cr(VI)) chromic acid. Hexavalent chromium is harmful to humans and the environment, and is classified as CMR (Carcinogenic, Mutagenic and Reprotoxic).

The aim is therefore to eliminate the use of hexavalent chromium, which is harmful to health and the environment.

A method for manufacturing a part (piece) having a coating layer by thermal spraying of the HVOF (High Velocity Oxygen Fuel) type onto a substrate comprising a thickness of between 30 μm and 50 μm is known, especially from document EP2956564 B1 or document FR3002239 of the same patent family. The method comprises a first step of preparing the surface of the substrate to be coated by sandblasting, so as to increase its surface roughness Ra in the order of 0.6 to 1.6 μm. The method then comprises a step of forming the coating layer by HVOF-type spraying of a powder mixture containing grains of WC-type metal carbide and a Co and Cr binder for this carbide onto the prepared substrate. These carbide grains have dimensions strictly smaller than 1 μm and preferably in the order of 450 nm+/−50 nm and the thickness of the finished coating layer thus formed is less than 50 μm. The method then comprises a step of finishing the surface by polishing said coating layer in such a way as to ensure that its roughness Ra is less than 1.6 μm, so as to obtain the dimensions and surface finish required in the plane. These deposits provide corrosion resistance of around 500 hours in a salt mist (salt spray testing) and reduce the risk of the coating breaking off/peeling (of cracking or delamination) from the substrate. However, this solution is inadequate because, in the aviation sector, there is a need for improved corrosion resistance while also providing spalling (scalling) resistance compared with prior art. Indeed, the corrosion test in the aviation sector is currently 1000 hours in a salt mist, and it has been demonstrated that corrosion resistance is not systematic, especially on a cylindrical substrate.

Furthermore, the sandblasting step in this solution is costly and has an impact on the environment. The sandblasting step increases the roughness of the substrate and consequently increases the surface roughness profile Rt (Rt>20 μm). The overall height of the surface roughness profile Rt corresponds to the sum of a height Zp of the largest profile peak and a depth Zv of the largest profile valley, within a cross-section having a length L measured in relation to a mean line of the profile. In other words, the greatest distance between the highest peak and the deepest trough.

Furthermore, it is described in this document that it was previously known to deposit a coating layer, obtained with grains of several micrometres, having a thickness greater than 75 μm and then to grind it (removing at least 50 μm for grinding).

There is a need to reduce the manufacturing cost of this method while maintaining corrosion resistance, especially for thin coating thicknesses (<100 μm) in the finished state of this manufacturing method.

The invention herein set forth is therefore directed to the improvement of this method for producing HVOF deposits.

SUMMARY OF THE INVENTION

It has been noticed in-house, without publication, that by impregnating a coating layer before being polished using an organic impregnant, the coating layer can have a finished thickness of less than 80 μm while complying with the corrosion and spalling resistance criteria by dispensing with the sandblasting step.

It has also been noticed in-house, without publication, that by applying a coating layer as in EP2956564 but with a finished thickness of 55 μm, there was still a corrosion problem in the 1000-hour corrosion test.

However, this impregnation step is an additional step and thus a restriction in terms of cost and time, as well as from a health, safety and environmental point of view.

The invention offers a solution improving the method described in EP2956564 B1, since it dispenses with a surface sanding step prior to thermal spray coating and without adding an impregnation step, while having superior corrosion resistance by passing the 1000-hour corrosion test.

One aspect of the invention relates to a method for manufacturing a part comprising a metal substrate at least partially covered with a finished protective layer, the method successively comprising:

- a first, preparation step without modification of the surface by sandblasting, comprising a sub-step of shot blasting an initial surface to obtain a roughness of the raw surface having an overall surface roughness profile height Rt of between 10 μm and 15 μm and a sub-step of cleaning the raw surface of the raw substrate,
- a second step of forming, by spraying a powder mixture containing submicron metal carbide grains according to a high-pressure liquid HVOF type thermal spraying process, onto the cleaned raw surface having its prepared roughness, a raw coating layer with a thickness of between 95 μm and 125 μm,
- a third step of polish finishing the surface of said raw coating layer made from the powder mixture so as to form the finished protective layer forming a polished surface having a roughness Ra of less than 0.2 μm, the finished protective layer having a thickness of between 75 μm and 100 μm.

Surprisingly, by depositing a finished protective layer greater than 75 μm, without adding impregnation, on a cleaned (prepared) raw surface of the substrate, a roughness of the raw surface having an overall surface roughness profile height Rt of between 10 μm and 15 μm by shot blasting only during preparation, the finished coating layer greater than 75 μm adheres and does not spall (unlike prior art in document FR3002239 involving a sandblasting step on the substrate and a layer of smaller thickness). In other words, the invention is free of a sandblasting step but does include a shot blasting step. Shot blasting is a technique consisting in spraying metal shot onto the surface of an object to carry out a surface treatment, the aim of which is to improve the appearance of the part. Shot blasting further closes microscopic cracks (invisible to the naked eye) which, in use, cause sealing faults due to internal pressure. This is an additional guarantee against corrosion. Shot blasting, known for modifying the surface structure and therefore the appearance of the object or part, makes it possible to obtain a higher surface roughness (Ra having a lower value) and makes it possible to obtain a smaller overall height of the surface roughness profile Rt (here between 10 μm and 15 μm) than by a sandblasting step (Rt>20 μm) known for eliminating impurities in order to be compatible with the adhesion of a powder or liquid coating or paint. Thus, it is surprising that using only shot blasting instead of or without sandblasting to add a coating layer results in a thicker coating layer (finished layer greater than 75 μm) that adheres and does spall. Furthermore, as the layer is thicker, it improves corrosion resistance and thus enables it to withstand the 1000-hour corrosion test.

By initial surface of the substrate, it is meant a surface with no change in roughness of the as-manufactured substrate, whether by moulding or machining (i.e. the initial surface has not undergone any treatment such as sandblasting).

By cleaned raw surface, it is meant the initial surface which has undergone the preparation step, i.e. shot blasting of the initial surface and cleaning.

By prepared surface, it is thus meant in the following description the cleaned raw surface (preparation by shot peening according to PCS-2300 on the initial surface to obtain Ra of between 0.6 and 1.6 μm and cleaning).

By raw coating layer constituted from the powder mixture, it is meant that the layer consists solely of 100% material originating from the powder mixture and therefore does not include any additional material such as an organic impregnant.

By submicron metal carbides, it is meant that the metal carbide grains each have a dimension strictly less than 1 μm (submicron carbides).

By HVOF thermal process, it is meant the thermal process known as High Velocity Oxygen-Fuel which is a high velocity thermal process using liquid fuel (paraffin).

The invention makes it possible to have a substrate with optimised thickness of the raw coating layer without increasing the roughness of the substrate surface by sandblasting, while improving corrosion resistance. This thus makes it possible to optimise the amount of powder mixture without the need for a roughness modification step or an impregnation step with an organic impregnant, while improving the level of corrosion resistance compared with prior art solutions. In other words, the solution makes it possible to dispense with additional costly steps such as preparation of the substrate by sandblasting directly onto an initial surface or after a shot blasting step on the initial surface or impregnation.

The raw thickness of between 95 μm and 120 μm is especially due to a manufacturing tolerance by the high velocity thermal spraying process using liquid fuel (paraffin) of the HVOF type, but also related to the amount of shrinkage required during polishing to obtain a finished surface with a roughness Ra<0.2 μm, as well as a manufacturing tolerance for the assembly of parts. Given that the interest is to use as little submicron metal carbide grains as possible for the environment and for cost reasons, while having good corrosion resistance, the applicant has noticed surprisingly and unexpectedly, that by adding 25 μm of finished thickness of the polished surface according to the method of the invention (without sandblasting) (corresponding to the coating layer thickness of between 75 μm and 100 μm with a polished surface having a roughness Ra less than 0.2 μm) compared to the solution of patent FR3002239 as well as that mentioned in its prior art, allows to pass 1000 hours salt tests, i.e. to double the corrosion resistance compared to the solution of patent FR3002239 as well as that mentioned in its prior art.

The spraying step according to the invention deposits a layer thickness equal to the dimensioning according to a desired dimension plus an oversize removed by polishing. Indeed, the step of polish finishing the coating layer makes it possible to remove a thickness strictly less than 30 μm (especially between 20 and 25 μm) whereas grinding removes at least 50 μm to take roughness but also geometric faults of the part into account. Thus, after a polishing step, by removing a maximum of 30 μm of coating layer thickness, it is possible to obtain a thickness of between 75 μm and 100 μm and a roughness of less than 0.2 μm. Of course, the dimensioning and manufacturing tolerance of the raw substrate will be adapted according to the manufacturing tolerance of the finished part (substrate tolerance+finished protective layer tolerance).

In conclusion, surprisingly, and contrary to what is indicated in document FR3002239, it is possible to have a coating layer thickness beyond 75 μm, while dispensing with the sandblasting step (the sandblasting having a roughness whose overall roughness profile height Rt of the raw surface is greater than 20 μm). The fact of having a final roughness of less than 0.2 μm, and a layer formed with submicron metal carbide grains, having a finished thickness of between 75 μm and 100 μm, also makes it possible to dispense with problems of spalling of the coating deposited. Furthermore, by adding only 25 to 50 μm more coating than in document FR3002239, corrosion resistance is doubled.

Furthermore, in prior art, it was necessary to prepare the initial or raw surface (after shot blasting) of the substrate by sandblasting to increase roughness of the surface and thus increase adhesion surface of the coating layer. Here, by virtue of the invention, as the protective layer is compact, it has been noticed that the level of mechanical adhesion of the protective layer to the cleaned raw surface of the substrate to be coated is sufficient without increasing the risk of spalling. Thus the invention enables such a substrate to clean only its raw surface comprising an overall height of surface roughness profile Rt of between 10 μm and 15 μm and not to modify its surface as in prior art, by sandblasting.

Further to the characteristics just discussed in the preceding paragraph, the method according to one aspect of the invention may have one or more additional characteristics from among the following, considered individually or according to any technically possible combinations:

According to one embodiment, the liquid fuel is paraffin.

According to one embodiment only, the HVOF type thermal spraying process is high pressure. This type of HVOF makes it possible to have higher particle velocities, which makes it possible to ensure good adhesion of small particles to the substrate.

According to one embodiment, the method for manufacturing a part comprises a pre-step of manufacturing the substrate, prior to the preparation step consisting in machining a substrate forming an initial surface.

According to another embodiment, the method for manufacturing a part comprises a pre-step of manufacturing the substrate, prior to the preparation step, comprising releasing mould of a substrate forming an initial surface.

According to one embodiment, the method consists of a pre-step of manufacturing the substrate and successively the first step, the second step and the third step.

By consisting of the pre-step and the three successive steps mentioned above, it is meant without other steps, i.e. without a grinding or sanding step or a step for adding material to the layer, for example without impregnation with an organic impregnant.

According to one embodiment, the substrate cleaning sub-step makes it possible to obtain a raw surface free of dirt or grease. The cleaning sub-step may be a degreasing step which simplifies and reduces the cost and time of such a method. The preparation step makes it possible to improve adhesion of the submicron grains to form the raw coating layer.

According to one example of the preceding embodiment, the cleaning sub-step is only a degreasing step in order to obtain a degreased raw surface, and in that the preparation step consists solely of the shot blasting sub-step and the cleaning sub-step. The cleaning sub-step makes it possible to improve adhesion of the submicron grains in order to form the coating layer.

According to one embodiment, the metal carbide grains each have a dimension strictly less than 1 μm (submicron carbides) and are mostly in the order of 400 to 800 nm in mean grain size. Grain sizes of this size enable the HVOF type spraying process to produce a compact coating layer while adhering to a substrate surface with a prepared roughness of between 0.6 and 1.6 μm. Furthermore, the fact of polishing the surface of the coating layer formed by grains of this size whose as-sprayed deposit has a roughness of Ra~3-5 μm down to a roughness of 0.2 μm makes it possible to resist corrosion. Furthermore, this allows a reduction in the spraying time required to produce the finished protective layer and thus a reduction in the mass of the raw coating layer thus formed.

Furthermore, the thickness of the coating layer has a peel strength under stress (also known as «spalling» resistance) which is much greater than required in the field of the invention, and the fact that the thickness does not exceed 100 μm reduces the forces transmitted by the coating-substrate interface.

Another aspect of the invention not claimed relates to a part comprising a metal substrate and a finished protective layer, obtained according to the manufacturing method the first aspect of the invention with or without the different characteristics described in the preceding paragraphs.

Another aspect of the invention not claimed relates to a part comprising a metal substrate and a finished protective layer consisting of a powder mixture containing submicron metal carbide grains deposited according to an HVOF type spraying process, the finished protective layer being deposited onto a raw surface of the substrate having a roughness prepared by shot blasting to obtain a raw surface having a prepared roughness Ra of between 0.6 and 1.6 μm, and comprising a polished surface having a roughness of less than 0.2 μm.

Such a part has a lower production cost than a part (piece) according to the method described in EP2956564 B1 while having better corrosion resistance.

According to one embodiment, the polished surface is intended to be subjected to fretting and/or turning. (By turning, it is meant forces subjected to a cylindrical part of an axis, generally its end, pivoting in or on a part which holds it (yoke, bushing, flange, bearing)).

According to one example of this embodiment, the part is a hinge pin or an axle in the aeronautical field.

According to one embodiment, the polished surface is intended to be subjected to turning (trunnion) functions (for example an axle) as well as dynamic sealing (for example a sliding rod).

According to one embodiment, the polished surface is intended to be subjected to static and/or dynamic sealing zones. For example, the part is a sliding rod.

The invention and its different applications will be better understood upon reading the following description and upon examining the accompanying figures.

BRIEF DESCRIPTION OF THE FIGURES

The figures are set forth by way of indicating and in no way limiting purposes of the invention.

FIG. 1*a* represents a schematic representation of a cross-section of a part comprising a substrate having a raw surface.

FIG. 1*b* represents a schematic representation of a cross-section of a part comprising a raw coating layer on a cleaned and prepared raw surface of the substrate.

FIG. 1*c* represents a schematic representation of a cross-section of a part comprising a finished protective layer on the substrate.

FIG. 2 shows a schematic representation of the manufacturing method.

FIG. 3 schematically shows a sample having undergone a corrosion test in a saline atmosphere comprising a surface polished according to the invention and a protective surface polished according to prior art.

DETAILED DESCRIPTION

The figures are set forth by way of indicating and in no way limiting purposes of the invention.

As previously indicated, the manufacturing method according to the invention is preferably used to produce a part 1, a magnified cross-section of which is schematically represented in FIG. 1*c*.

In particular, use is made of the part 1 in the aeronautical field.

The part 1 in cross-section represented in FIG. 1*c* comprises a metal substrate Sub partially represented and a finished protective layer Rf comprising a polished surface S3.

FIG. 2 represents a flow chart of a method for manufacturing the part 1.

The part 1 is generally made by machining to have at least one portion of a cylindrical surface in the case of a rod, which may be a hinge pin, an axle or even a sliding rod of a landing gear. This cylindrical portion is hereinafter referred to as the substrate Sub. The finished protective layer Rf is therefore annular and herein is intended to function in static and/or dynamic sealing zones. For example, the finished protective layer Rf is intended to be subjected to joint friction to allow the rod to slide relative to a strut of the landing gear or is intended to be subjected to fretting and/or turning, for example for a hinge pin or an axle.

The finished protective layer Rf should provide protection against corrosion of the part, sealing between the polished surface S3 of the finished protective layer Rf and another part, for example the strut landing gear, to limit the risk of hydraulic fluid leaks, wear resistance under pressure, and «spalling» resistance, also known as spalling tests, with alternating tensile and compressive movements with a load ratio of R=−1.

It is noted that the substrate Sub is a metal alloy of the steel or titanium type.

In the following example, the aim is to manufacture a finished part 1 having a cylinder with a diameter of 13 mm with a total manufacturing tolerance (substrate+polish finishing) of + or −0.4 μm.

The manufacture of the substrate Sub is here, for example, machining by lathe to obtain a diameter of 12.82 mm with a manufacturing tolerance.

As is seen in FIG. 2, the method for manufacturing part 1 comprises a step A of preparing a raw initial surface S1 of substrate Sub, to obtain a prepared raw initial surface S1*n* to be covered by the finished protective layer rf. FIG. 1*a* represents a cross-section of the substrate Sub comprising its initial raw surface S1 and the prepared raw surface S1*n* is referenced in FIG. 1*c* as well as in FIG. 1*b* representing the part 1 comprising the prepared raw surface S1*n* covered with a raw coating layer Rb. In this example, the preparation step A herein comprises a degreasing sub-step and a shot blasting sub-step. The preparation step A therefore modifies roughness of the initial surface into a raw surface S1 of the substrate by shot blasting, which is then cleaned. The cleaned raw surface S1*n* has therefore not been sand blasted or sanded.

The sub-step of shot blasting the initial surface makes it possible to obtain a raw surface with an overall height of the surface roughness profile Rt, represented in FIG. 1*a*, of between 10 μm and 15 μm, unlike sandblasting, which generates roughness with an overall height of the surface roughness profile Rt greater than 20 μm. Shot blasting also makes it possible to obtain a prepared roughness Ra of between 0.6 and 1.6 μm.

Herein, in this example, the cleaning sub-step is solely degreasing the initial raw surface S1 of the substrate forming a cleaned raw surface S1*n* having a roughness Ra identical to that of the raw surface S1, for example 1.6 μm. The roughness of a surface can for example be measured according to standards ISA3274-1997, ISO 4287-1997, ISO 4288-1996, ISO 11562.

The method for manufacturing the part 1 comprises, after the preparation step A, a step B of forming a raw coating layer Rb, on the cleaned (prepared) raw surface S1*n*, herein degreased, of the substrate Sub, by HVOF-type spraying of a powder mixture containing submicron metal carbide grains. FIG. 1*b* represents a cross-section of the part 1 comprising the substrate Sub and the raw coating layer Rb deposited onto the cleaned surface S1*n*. The raw coating layer Rb comprises a raw coating surface S2 visible in this FIG. 1*b*.

In particular, in this example the grains have dimensions strictly less than 1 μm and the thickness Epmax of the raw coating layer Rb thus formed is between 95 and 120 μm, for example in this example the thickness is between 100 and 110 μm. The thickness of the raw coating layer Rb is variable according to the manufacturing tolerances of the coating layer and thus enables a finishing step by polishing C, described later, to remove no more than 30 μm of the thickness of the coating layer removed, herein a maximum of 22 μm. This powder mixture contains metal carbide grains coated in a binder, herein tungsten carbide WC coated in cobalt Co and chromium Cr. The cobalt Co serves as a binder and the chromium Cr serves as protection against oxidation.

In this example, this powder mixture is in the form of agglomerates/aggregates whose powder particles are in the order of 20-30 μm and whose deposition by the HVOF process forms a stack of ceramic powder particles with a molten metal matrix. These ceramic powder particles are strictly smaller than 1 μm to form a maximum coating layer of less than 120 μm and greater than 95 μm. Agglomerates are generally produced by sintering to create bridges between the carbide and the binder material. This sintering is generally carried out with a furnace to melt the binder without decarburising the metal carbide grains.

Ideally, the metal carbide WC grains present in this powder mixture are calibrated to have a size strictly less than 1 μm, and preferably in the order of 400 to 800 nm in mean grain size.

It is noted that the present invention can be implemented with other types of chemical compositions containing at least one metal carbide and at least one binder. Examples of possible compositions include WCCo, which may be in the form of a mixture of 83% WC and 17% Co or in the form of a mixture of 88% WC and 12% Co, or WCCoCr.

As the raw coating layer Rb, and the powder agglomerates/aggregates have a small grain size, the resulting roughness at the raw coating surface S2 of the raw coating layer Rb in this example is in the order of 3 μm immediately after spraying.

The method for manufacturing part 1 comprises, directly after the forming step B, a third step of polish finishing the raw coating surface S2 to form the polished surface S3 having a roughness Ra of less than 0.2 μm until a part 1 is obtained having the wanted diameter, for example 13 mm, i.e. a radius of 6.5 mm. The finished protective layer Rf has a thickness of between 75 μm and 100 μm. Here in this example, the thickness of the finished protective layer Rf is between 88 and 92 μm due to the manufacturing tolerance of the substrate Sub and the tolerance of the polish finishing step.

The third polish finishing step is thus formed on the raw coating surface S2, removing a portion Rrp of the raw coating layer Rb thus forming the finished protective layer Rf having a thickness of between 88 and 92 μm.

The raw coating surface Rb is porous, comprising in this example (depending on the type of powder) pores having diameters of between 0.3 μm and 0.04 μm and 80% predominantly of between 0.25 and 0.1 μm. The median pore diameter is 0.2 μm per pore, with a porosity of 0.04 mL/g.

As previously set out, the raw coating layer Rb has a surface roughness Ra S2, here Ra of S2=3 μm of the same order of magnitude as the roughness Ra of the surface S1, here in this example 2 μm. The third step C of polish finishing the raw surface S2 ensures that the roughness Ra of the polished surface S3 of the finished protective layer Rf is less than 0.2 μm. Polishing can, for example, be carried out with a diamond strip.

The step of polishing the raw coating layer Rb reduces the thickness of this layer until a dimension of the part is obtained, here a cylinder with a diameter of 13 mm whose manufacturing tolerance is + or −0.4 μm. Herein, the polishing step reduces the thickness of the raw coating layer Rb by removing a part Rrp of the raw coating layer having a thickness between 12 and 18 μm. In this example, the finished protective layer Rf thus has a lower thickness of between 88 and 92 μm with a roughness Ra of 0.2 μm, thus enabling a part diameter of 13 mm (substrate: 12.82 mm) to be obtained with a tolerance of + or −4 μm+(2 times (radii) the thickness of the coating layer 88 and 92 μm)+ or −0.4 μm.

Polishing the raw surface S2 by removing a thickness of a part Rrp of the raw coating layer Rb until the finished protective layer Rf is formed until a roughness Ra of less than 0.2 μm is obtained, thus allowing the polished surface S3 to be subjected to static and/or dynamic sealing zones while having corrosion resistance.

It is to be noted that traditionally, a coating layer grinding step is required to obtain a given layer geometry and layer surface finish. However, the grinding of an annular layer formed on a straight cylindrical portion makes it necessary to provide a significant layer thickness to ensure that, after grinding, a minimum layer thickness is maintained on the substrate.

By eliminating the step of grinding the annular layer, the method according to the invention makes it possible to obtain the desired layer thickness directly without having to grind the coating layer of the part, thus eliminating the risk of grinding faults appearing (grinding a cylindrical annular layer frequently leads, due to uncertainties in positioning the part on the grinding machine, to the appearance of layer zones which are too thin, difficult to detect and likely to promote premature corrosion of the substrate). The invention eliminates this risk of having a locally too thin layer that cannot be detected.

FIG. 3 schematically represents a test piece 2 comprising, on the left, a polished surface S3 of the finished protective layer rf formed like the part 1 according to the method of the invention, and, on the right, a surface of the coating layer S4 comprising a maximum thickness of 50 μm with a roughness Ra of 1.6 μm.

The test piece 2 has been tested for corrosion resistance in a saline atmosphere (salt mist) according to ASTM B117.

Test pieces 2' and 2" correspond to test piece 2 after 1000 h in a saline atmosphere.

It can thus be seen that the surface S3 of the part according to the invention with a minimum deposit thickness of 75 μm of test tube 2 shows no trace of pitting (left-hand part) even after 1000 h of exposure to salt mist. On the other hand, the surface S4 with a thin coating layer (right-hand side) is attacked: firstly with pitting marks 9 and then with widespread corrosion development 90.

Furthermore, a wear resistance test has been carried out on a part 1 obtained using the method of the invention having a cylindrical zone with a diameter of 10 mm comprising the surface S3 and to which a bronze ring (AMS4590) is mounted, in the presence of a grease. The wear test comprises a first phase of 500 cycles of pressure of the ring on surface S3 at 50 MPa, then a second phase of 500 cycles at 100 MPa and a final phase with 4000 cycles at 200 MPa, and a frequency of 0.1 Hz. The coefficient of friction and the wear rate (measurement of the outer diameter of the axis and the inner diameter of the ring) are recorded every 500 cycles, and each time the grease is renewed. The test has shown that part 1 obtained with the method of the invention comprises a similar level of wear resistance performance with that according to the method in EP2956564 B1.

The manufacturing method the invention thus makes it possible to obtain a part which is less expensive than according to the method of document EP2956564 B1 while including a metal substrate Sub at least partially covered with a finished protective layer rf having a similar wear resistance and better corrosion resistance.

Furthermore, surprisingly, starting from a substrate that has only been cleaned without modifying its roughness by sandblasting in the preparation step, unlike the substrate that has undergone a sandblasting or sanding step in the preparation step in document EP2956564 B1, it is noticed that in the invention, the protective layer makes it possible to remain adhered to the raw surface having an overall roughness profile height Rt of between 10 μm and 15 μm. Furthermore, due to the increased thickness of the coating layer, the finished substrate of the invention is more resistant to corrosion than would be the case with the coating layer of this document EP2956564 B1, i.e. with a thickness of less than 50 μm and a roughness Ra of 1.6 μm.

Furthermore, a spalling test, i.e. no loss of adhesion between the deposit of the finished protective layer Rf and the substrate Sub of a test part, has been carried out, with alternating tensile and compressive movements with a load ratio of R=−1, on specimens with a finished protective layer rf with a thickness of 100 μm in the finished state. The test has shown that a piece including a metal substrate Sub at least partially covered with a finished protective layer Rf obtained according to the method for manufacturing the invention includes a spalling resistance under 1140 MPa, 1250 MPa and 1300 MPa for 100 μm thickness.

Finally, on the same principle as the spalling test, fatigue tests have been carried out on a part 1 obtained using the method of the invention. These tests consisted of alternating tensile and compressive movements under a load ratio R=0.1. The results obtained showed that the reduction defined in the past for this type of deposition/testing is still respected in the aerospace field.

By virtue of all these characteristics, the method of the invention makes it possible to obtain a finished part which is lighter, less costly and of at least the same level of performance, while retaining intact the characteristics necessary for proper sealing between the part 1 and another part.

It is to be noted that the carbide grains used may be of a type of metal carbide other than tungsten carbide and the binding materials may be of materials other than chromium and cobalt.

Unless otherwise specified, a same element appearing in different figures has a single reference.

The invention claimed is:

1. A method for manufacturing a part comprising a metal substrate at least partially covered with a finished protective layer, the method comprising successively:

a first, preparation step free of surface modification by sandblasting, comprising a sub-step of shot blasting an initial surface of the substrate to obtain a roughness of a raw surface having an overall surface roughness profile height Rt of between 10 μm and 15 μm and a sub-step of cleaning the raw surface, a second step of forming, by spraying a powder mixture containing submicron metal carbide grains according to a High Velocity Oxygen-Fuel thermal spraying process using liquid fuel out at a combustion pressure sufficient to produce an adherent carbide coating, on the cleaned raw surface having its prepared roughness, a raw coating layer, with a thickness of between 95 μm and 125 μm, a third step of polish finishing the surface of said raw coating layer constituted from the powder mixture so as to form the finished protective layer forming a polished surface having a roughness Ra of less than 0.2 μm, the finished protective layer having a thickness of between 75 μm and 100 μm.

2. The method according to claim 1, further comprising, prior to the first, preparation step, a pre-step of manufacturing the substrate, the pre-step of manufacturing the substrate comprising machining the substrate to form the initial surface.

3. The method according to claim 1, wherein the cleaning sub-step of the preparation step consists of a degreasing step of degreasing the raw surface.

4. The method according to claim 1, wherein a majority of the metal carbide grains are in the order of 400 to 800 nm in mean grain size.

* * * * *